US010231068B2

(12) United States Patent
Frei et al.

(10) Patent No.: US 10,231,068 B2
(45) Date of Patent: Mar. 12, 2019

(54) HEARING DEVICE FOR BEING WORN AT LEAST PARTLY WITHIN AN EAR CANAL AND A METHOD FOR MANUFACTURING SUCH A HEARING DEVICE

(71) Applicant: SONOVA AG, Staefa (CH)

(72) Inventors: Christian Frei, Staefa (CH); Natasha Oatman, Zurich (CH); Thomas Winkler, Rapperswil (CH); Matthias Stadler, Maennedorf (CH)

(73) Assignee: Sonova AG, Stäfa (CH)

( * ) Notice: Subject to any disclaimer, the term of this patent is extended or adjusted under 35 U.S.C. 154(b) by 0 days.

(21) Appl. No.: 15/745,137

(22) PCT Filed: Jul. 17, 2015

(86) PCT No.: PCT/EP2015/066461

§ 371 (c)(1),
(2) Date: Jan. 16, 2018

(87) PCT Pub. No.: WO2017/012638

PCT Pub. Date: Jan. 26, 2017

(65) Prior Publication Data

US 2018/0227686 A1 Aug. 9, 2018

(51) Int. Cl.
*H04R 25/00* (2006.01)

(52) U.S. Cl.
CPC ..... *H04R 25/658* (2013.01); *H04R 25/65* (2013.01); *H04R 25/652* (2013.01); *H04R 25/60* (2013.01); *H04R 2225/023* (2013.01); *H04R 2225/025* (2013.01); *H04R 2225/77* (2013.01)

(58) Field of Classification Search
CPC ..... H04R 25/60; H04R 25/65; H04R 25/652; H04R 25/658; H04R 2225/77; H04R 2225/023; H04R 2225/025
USPC ..... 381/322, 328
See application file for complete search history.

(56) References Cited

U.S. PATENT DOCUMENTS 2,248,837 A 7/1941 Walters
7,983,434 B2 * 7/2011 Rohrlein ..... H04R 25/652 381/322
8,032,337 B2 * 10/2011 Deichmann ..... A61F 11/08 345/419

(Continued)

FOREIGN PATENT DOCUMENTS

EP 1 341 397 A2 9/2003
EP 2 615 854 A1 7/2013

(Continued)

OTHER PUBLICATIONS

WIPO the International Searching Authority, the Written Opinion of the International Searching Authority for PCT/EP2015/066461, European Patent Office in Rijswijk, NL.

*Primary Examiner* — Jesse A Elbin

(57) ABSTRACT

The present invention provides a hearing device (1) for being worn at least partly within an ear canal of a user of the hearing device (1), the hearing device (1) comprising a shell (2) with a wall and an opening (4), wherein the wall has a rim (11) at the opening (4), and wherein the wall is thickened along at least part of the rim (11). Furthermore, a method for manufacturing such a hearing device (1) is specified, especially comprising determining an area of a bonding surface (12) at the rim (11) for bonding a face plate (3) to the shell at the opening (4).

20 Claims, 3 Drawing Sheets

(56) References Cited

U.S. PATENT DOCUMENTS

| | | | | |
|---|---|---|---|---|
| 2003/0074174 | A1 | 4/2003 | Fu | |
| 2003/0152242 | A1 | 8/2003 | Maxen et al. | |
| 2006/0115105 | A1 | 6/2006 | Brumback et al. | |
| 2017/0280260 | A1* | 9/2017 | Stadler | H04R 25/652 |

FOREIGN PATENT DOCUMENTS

| | | | |
|---|---|---|---|
| JP | H11 55797 | A | 2/1999 |
| WO | WO 2006/117407 | A2 | 11/2006 |

* cited by examiner

HEARING DEVICE FOR BEING WORN AT LEAST PARTLY WITHIN AN EAR CANAL AND A METHOD FOR MANUFACTURING SUCH A HEARING DEVICE

TECHNICAL FIELD

The present invention pertains to the field of hearing devices, more particularly to hearing devices adapted to be worn at least partly within an ear canal. The present invention especially relates to such hearing devices of various sizes that comprise a thin shell to which a face plate is attached, where a secure attachment of the face plate to the shell poses a problem due to the thinness of the shell.

BACKGROUND OF THE INVENTION

Hearing devices such as hearing aids (also referred to as hearing prostheses or hearing instruments) for hard of hearing people or hearing enhancement devices for augmenting the hearing capability of normal hearing persons, as well as hearing protection devices designed to prevent noise-induced hearing loss are often adapted to be worn at least partly within the ear canal (e.g. in the form of an in-the-ear, ITE, a completely-in-canal, CIC or a receiver in the ear, RITE hearing device) so as to be inconspicuous or for performance reasons, e.g. to seal the ear canal and prevent sound from directly reaching the ear drum. Such hearing devices typically contain many components housed within a shell. Due to the limited space available within the ear canal, the shell should be as small as possible. One way of achieving this is to reduce the thickness of the wall of the shell. However, this makes it difficult to securely attach a face plate to the shell. The attachment of the face plate onto the shell must thereby be sufficiently secure to allow pulling on a removal filament affixed to the face plate for removing the hearing device from the ear canal as well as to allow opening and closing a battery door comprised in the face plate, without the face plate being unintentionally separated from the shell. On the other hand the attachment of the face plate onto the shell should not be so strong that the two cannot be separated again when necessary without destroying them, for instance in order to repair the hearing device, e.g. by replacing a faulty component housed within the shell.

SUMMARY OF THE INVENTION

It is an object of the present invention to provide a hearing device for being worn at least partly within an ear canal, where the face plate can be securely attached to the shell even for very thin shells. This object is achieved by the hearing device specified in claim 1. Further embodiments of such a hearing device are given in the dependent claims 2 to 9. It is a further object of the present invention to provide a method for manufacturing such a hearing device. This object is achieved by the manufacturing method specified in claim 10. Further embodiments of such a manufacturing method are given in the dependent claims 11 to 14.

The present invention provides a hearing device for being worn at least partly within an ear canal of a user of the hearing device, the hearing device comprising a shell with a wall and an opening, wherein the wall has a rim at the opening, and wherein the wall is thickened along at least part of the rim. In particular, a thickness of the wall along said part of the rim is greater, for instance by a factor of 1.2 or more, than a thickness of the wall distant from the rim.

In an embodiment of the hearing device the rim has the form of a bulge or shoulder. More particularly, the rim has the form of a lip, collar or flange.

In a further embodiment the hearing device further comprises a face plate and the rim features a bonding surface, the face plate being bonded to the shell at said bonding surface.

In a further embodiment of the hearing device the face plate is bonded to the shell at the bonding surface by means of an adhesive, wherein an area of the bonding surface is adapted in dependence of a bonding characteristic of the adhesive such that the shell and the face plate are bonded together by means of the adhesive with a predetermined bonding force.

In a further embodiment of the hearing device the area of the bonding surface is adapted in dependence of a diameter of the opening.

In a further embodiment of the hearing device the area of the bonding surface is adapted in dependence of a thickness of the wall.

By varying the dimensions of the thickening of the rim the bonding surface can be adapted such that a certain, desired bonding force is achieved when the face plate is bonded, e.g. glued, to the shell at the bounding surface by means of an adhesive. The thickening of the rim therefore provides an enlarged bonding surface when the shell wall is too thin to provide a sufficient area to apply the adhesive.

In a further embodiment of the hearing device the bonding surface has the form of a flat annular stripe, wherein the mean width of the annular stripe is greater than 0.4 mm.

In a further embodiment of the hearing device there is a groove or recess within the bonding surface. By incorporating a groove or recess within the bonding surface the bonding force can be reduced when the face plate is bonded, e.g. glued, to the shell. By appropriately dimensioning the groove or recess the resulting bonding force can be adjusted dependent on the type of adhesive being employed and dependent on the characteristics of the face plate material and the shell material.

In a further embodiment of the hearing device the wall excluding the thickened part at the rim has a mean thickness of less than 0.4 mm, in particular of 0.2 mm.

In a further embodiment the hearing device further comprises a vent formed along an outer portion of the shell, wherein the vent has a proximal opening with a proximal rim at a proximal end of the hearing device and a distal opening with a distal rim at a distal end of the hearing device, and wherein the wall of the vent is at least partly thickened at said proximal rim and/or at said distal rim.

In a further embodiment of the hearing device the proximal rim and/or the distal rim has a rounded shape with a radius of at least 0.2 mm.

By thickening and rounding off the proximal rim and/or the distal rim sharp edges are avoided that might injure or irritate the skin of the ear canal, especially during insertion or removal of the hearing device from the ear canal. Moreover, by forming the vent along an outer portion of the shell the placing and arrangement of the components within the shell is greatly facilitated.

In a further embodiment of the hearing device the shell is made of metal, in particular of titanium. Using metal and in particular titanium as shell material allows to manufacture especially thin shells, which requires the wall to be thickened along at least part of the rim, as provided by the present invention.

In a further embodiment of the hearing device the shell has an outer surface that is custom-shaped according to an inner shape of at least a section of the ear canal of the user, the shell thus being individually shaped for the user.

The present invention further provides a method for manufacturing a hearing device for being worn at least partly within an ear canal of a user of the hearing device. The hearing device to be manufactured comprises a shell and a face plate, wherein the shell comprises a wall and an opening, and the wall has a rim at the opening. The proposed manufacturing method comprises the steps of:

- providing data defining geometrical constraints regarding size and shape of the shell, in particular of the wall and the opening;
- determining an area of a bonding surface at the rim for bonding the face plate to the shell at the opening;
- generating a three-dimensional computer model of the shell taking into account the provided data such that the shell has an outer surface which fulfils the geometrical constraints regarding size and shape of the shell given by the provided data, wherein the bonding surface is configured to have the determined area;
- forming the shell according to the three-dimensional computer model by a rapid prototyping process, such as for instance selective laser sintering, stereolithography, photopolymerisation, fused deposition modelling or 3D printing; and
- bonding the face plate to the shell at the bonding surface by means of an adhesive, wherein as part of generating the three-dimensional computer model of the shell, at least part of the rim is thickened relative to a thickness, e.g. a mean thickness, of the wall distant from the rim, for instance by a factor of 1.2 or more.

In an embodiment of the method, as part of generating the three-dimensional computer model of the shell, the rim is adapted to form a bulge or shoulder, more particularly to form of a lip, collar or flange.

In a further embodiment of the method the area of the bonding surface is determined in dependence of at least one of:

- a bonding characteristic of the adhesive, in particular such that it is ensured that upon assembly the shell and the face plate are bonded together by means of the adhesive by a predetermined bonding force;
- a diameter of the opening;
- a thickness of the wall, for instance a mean thickness of the wall;
- a material of the shell;
- a material of the face plate.

In a further embodiment of the method, as part of data defining geometrical constraints regarding the size and shape of the wall, the wall is provided to have a mean thickness of less than 0.4 mm, in particular of 0.2 mm.

In a further embodiment of the method, as part of generating the three-dimensional computer model of the shell, the shell is adapted to have a groove or recess within the bonding surface.

In a further embodiment of the method the thickening comprises rounding the rim to a radius of at least 0.2 mm.

In a further embodiment of the method the shell is formed of metal, in particular of titanium.

In a further embodiment the method further comprises the step of:

- measuring an inner shape of at least a section of the ear canal of the user, wherein the data defining geometrical constraints regarding the size and shape of the shell is based on the measured inner shape of the section of the ear canal of the user, the shell thus being individually shaped for the user.

In a further embodiment of the method the bonding characteristic of the adhesive is determined based on bonding force tests, in particular in dependence of at least one of a type of the adhesive, a material of the shell, and a material of the face plate.

It is pointed out that combinations of the above-mentioned embodiments can yield even further, more specific embodiments according to the present invention.

BRIEF DESCRIPTION OF THE DRAWINGS

The present invention is further explained below by means of non-limiting specific embodiments and with reference to the accompanying drawings, which show.

Figure 4:
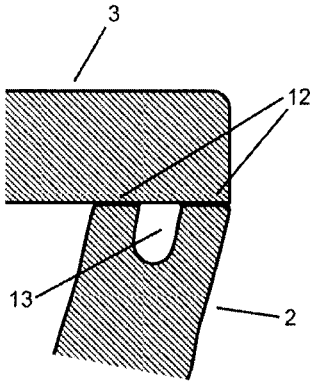
Figure 5:
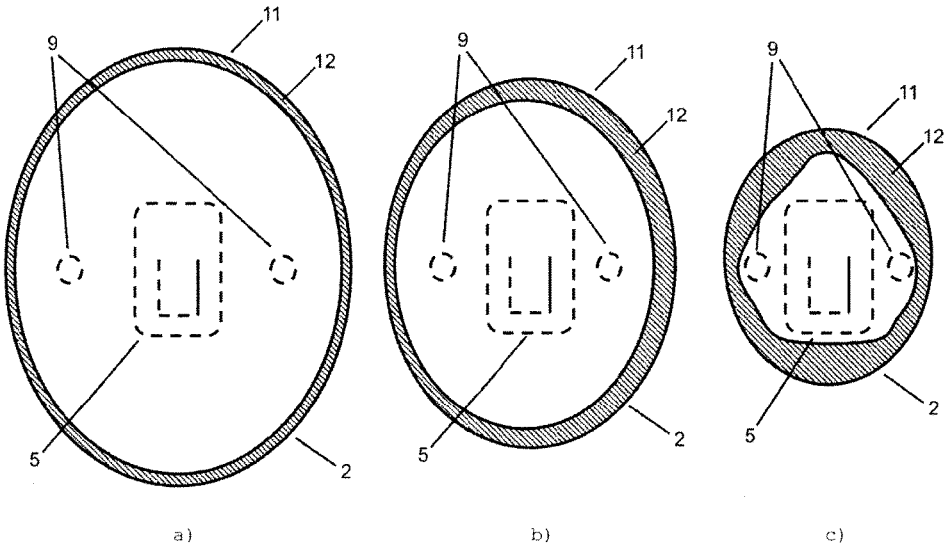

*b*) a close-up, cross-sectional view of a portion of an in-the-ear (ITE) hearing device according to the present invention;

FIG. 4 a close-up, cross-sectional view of a portion of an in-the-ear (ITE) hearing device according to an alternative embodiment of the present invention;

FIG. 5 *a*) a top view of a large ITE;

*b*) a top view of a small ITE;

*c*) a top view of a CIC; and

Figure 6:
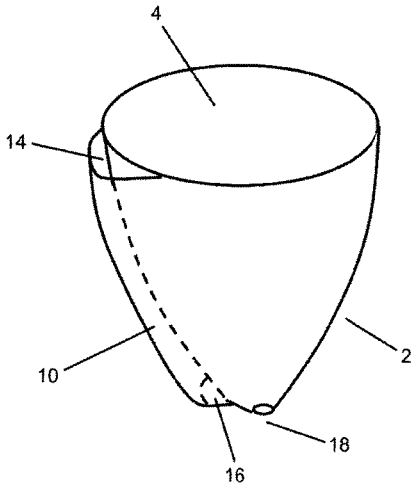

FIG. 6 schematically, a perspective view of a hearing device shell with a vent according to the present invention.

In the figures like reference signs refer to like or corresponding elements.

DETAILED DESCRIPTION OF THE INVENTION

Figure 1:
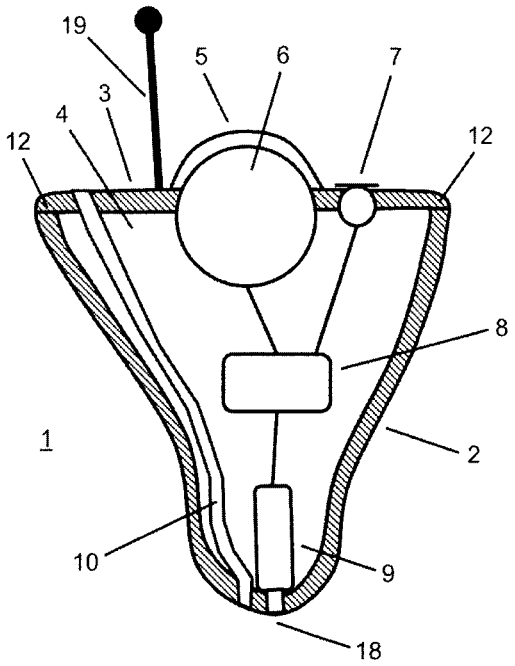
FIG. 1 schematically, a cross-sectional view of an in-the-ear (ITE) hearing device according to the state of the art.

FIG. 1 schematically depicts in a cross-sectional view an in-the-ear (ITE) hearing device 1 according to the state of the art. The ITE hearing device 1 comprises a shell 2 with an opening 4 at its distal end, which is closed during assembly of the hearing device 1 with a face plate 3. The face plate 3 includes a battery door 5, which can be opened to insert a battery 6. Typically closing and opening the battery door 5 will turn the hearing device 1 on and off, respectively. Furthermore, a microphone 7 is mounted at or directly under the face plate 3. Additionally, a removal filament 19 is affixed to the face plate 3 in order to allow to easily pull the hearing device 1 out of the ear canal. The sound picked up by the microphone 7 is processed according to the needs of the user, e.g. typically amplified in the case of a hearing aid for a hard of hearing person, and the processed sound signal is subsequently output by a miniature loudspeaker 9, commonly also referred to as a receiver. The output sound produced by the receiver 9 is passed into the ear canal of the user via the sound outlet 18 at the proximal end of the hearing device 1. A vent 10, i.e. a thin tube, traverses the hearing device 1 from its proximal end to its distal end at the face plate 4, in order to allow for pressure equalisation and to achieve certain desired acoustical properties.

Figure 3:
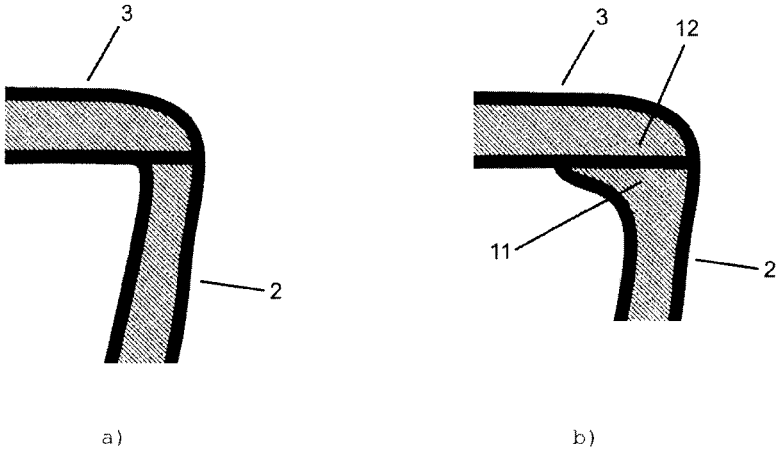
FIG. 3 *a*) a close-up, cross-sectional view of a portion of an in-the-ear (ITE) hearing device according to the state of the art.

In such a state of the art ITE hearing device 1 the face plate 3 is directly glued onto the rim of the shell 2 which has a constant width corresponding to the thickness of the shell 2. This is illustrated in FIG. 3 *a*). The gluing surface therefore essentially has an area equal to the circumference of the opening 4 times the thickness of the shell 2. Tiny completely-in-canal (CIC) hearing devices have a very small opening so that they can be deeply inserted into the ear canal. Their opening 4 is smaller compared to that of an ITE hearing device. Therefore, the gluing surface is smaller and consequently the achievable adhesive force for holding together the shell 2 and the face plate 3 is reduced. This is even more so the case when the thickness of the shell wall is decreased in order to achieve a higher fit rate, e.g. for persons having a very narrow ear canal.

Figure 2:
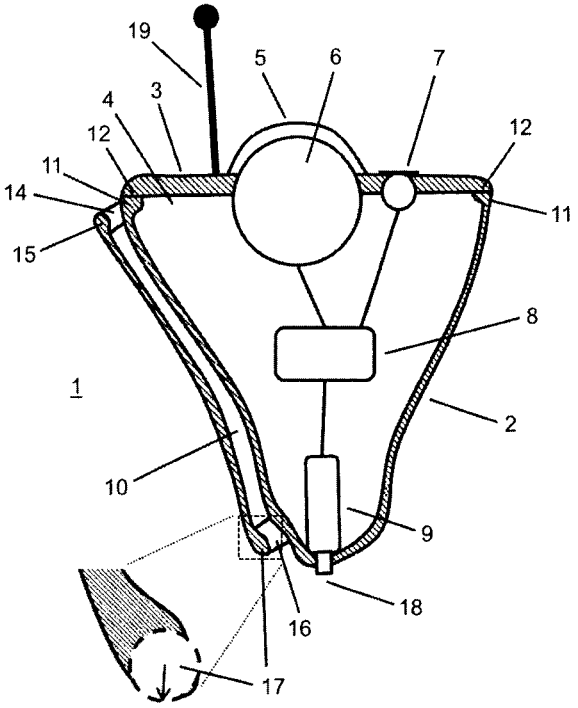
FIG. 2 schematically, a cross-sectional view of an in-the-ear (ITE) hearing device according to the present invention.

FIG. 2 schematically depicts in a cross-sectional view an in-the-ear (ITE) hearing device 1 according to the present invention, which is adapted to achieve a sufficiently secure attachment of the face plate 3 to the shell 2 even for tiny CIC hearing devices having a very thin shell wall, for instance made of metal, in particular titanium. As can be seen in FIG. 2 the shell wall is thickened along at least part of the rim 11. This is illustrated in FIG. 3 *b*). For instance the rim 11 has the form of a bulge or shoulder, or in particular has the form of a lip, collar or flange. The thickness of the wall along this part of the rim 11 is chosen to be greater, for example by a factor of 1.2 or more, than the thickness of the wall distant from the rim 11. Thus the rim 11 features a bonding surface 12, onto which the face plate 3 is bonded by means of an adhesive. The bonding surface 12 has the form of a flat annular stripe, where the mean width of the annular stripe for example is greater than 0.4 mm.

Depending to the required bonding force, the thickening of the rim 11 is adapted during the 3D shell modelling process. The dimensioning of the bonding surface 12 is determined taking into account the bonding characteristic of the adhesive and the characteristics of the shell material and the material of face plate 3. The area of the bonding surface 12 is also adapted in dependence of the diameter or circumference of the opening 4. The appropriate dimensioning of the bonding surface 12 can for instance be performed automatically by the 3D shell modelling software.

The bonding surface 12 can be reduced by introducing a groove 13 or recess within the bonding surface 12. This is illustrated in FIG. 4. The 3D shell modelling software may automatically introduce an appropriately dimensioned groove 13 or recess within the bonding surface 12, if this is determined to be necessary in order to reduce the bonding force.

FIG. 5 shows in a top view three hearing devices having different sizes: a) a large ITE, b) a small ITE, and c) a CIC hearing device. The large ITE a) only requires little thickening of the rim 11 in order to provide a bonding area sufficient to achieve the necessary bonding force when the shell 2 is glued to the face plate 3. For the small ITE b) the thickening of the rim 11 needs to be increased since the circumference of the opening 4 is considerably smaller than in the case of the large ITE a). This is even more so the case for the CIC c) where the rim 11 has to be strongly thickened in order to provide a sufficiently large bonding area 12. As can be seen in FIG. 5 *c*) the thickening can be non-uniform (i.e. have a non-regular thickness) around the opening 4 in order to accommodate the various components mounted on the face plate 3, e.g. the battery door 5 and the two microphones 7.

As can be further seen in FIG. 2 the hearing device 1 may comprise a vent 10 formed along an outer portion of the shell 2 and having a proximal opening 16 with a proximal rim 17 at a proximal end of the hearing device 1 and a distal opening 14 with a distal rim 15 at a distal end of the hearing device 1. FIG. 6 schematically shows a perspective view of a hearing device shell with such a vent 10. Hereby, the wall of the vent 10 is at least partly thickened at said proximal rim 17 (cf. enlarged excerpt on the lower left side of FIG. 2) and/or at said distal rim 15. The proximal rim 17 and/or the distal rim 15 has a rounded shape with a radius of for instance at least 0.2 mm.

The invention claimed is:

1. A hearing device, the hearing device comprising:
- a shell forming a wall and an opening,
  - wherein the wall has a rim at the opening, and
  - wherein the wall is thickened along at least part of the rim by a factor of 1.2 relative to a thickness of the wall; and
- a face plate covering the opening,
  - wherein the rim further comprises a bonding surface, and
  - wherein the face plate is bonded to the shell at the bonding surface.

2. The hearing device of claim 1, wherein the bonding surface has a flat annular stripe, wherein the mean width of the annular stripe is greater than 0.4 mm, wherein the wall has a mean thickness of less than 0.4 mm excluding the thickened part at the rim.

3. The hearing device of claim 1, wherein the bonding surface forms a groove or recess, wherein the groove or recess is configured to reduce a bonding force between the faceplate and the shell to a predetermined value.

4. The hearing device of claim 2, wherein the wall has a mean thickness of less than 0.2 mm excluding the thickened part at the rim.

5. The hearing device of claim 2, further comprising:
- a vent formed along an outer portion of the shell,
  - wherein the vent has a proximal opening with a proximal rim at a proximal end of the hearing device and a distal opening with a distal rim at a distal end of the hearing device, and
  - wherein the vent is at least partly thickened at the proximal rim or at the distal rim.

6. The hearing device of claim 2, wherein the proximal rim or the distal rim has a rounded shape with a radius of at least 0.2 mm.

7. The hearing device of claim 2, wherein the shell comprises metal.

8. The hearing device of claim 2, wherein the shell comprises titanium.

9. The hearing device of claim 2, wherein the shell has an outer surface that is custom-shaped partially based on an inner shape of at least a section of an ear canal.

10. A method for manufacturing a hearing device, the method comprising:
- providing data defining geometrical constraints regarding size and shape of a shell, wherein the shell forms a wall, an opening, and a rim for a hearing device,
  - wherein the geometrical constraints include the wall is thickened along at least part of the rim by a factor of 1.2 relative to a thickness of the wall;
- determining an area of a bonding surface at the rim for bonding a face plate to the shell at the opening;
- generating a three-dimensional computer model of the shell taking into account the provided data such that the shell has an outer surface that fulfils the geometrical constraints regarding size and shape of the shell given by the provided data,
  - wherein the bonding surface is configured to have the determined area;
- forming the shell partially based on to the three-dimensional computer model by a rapid prototyping process; and bonding the face plate to the shell at the bonding surface by means of an adhesive, wherein as part of generating the three-dimensional computer model of the shell, at least part of the rim is thickened relative to a thickness of the wall distant from the rim.

11. The method of claim 10, wherein the area of the bonding surface is partially based on:

a predetermined bonding strength between the shell, the face plate, and adhesive that bonds together the shell and the face plate;

a diameter of the opening;

a thickness of the wall;

a material of the shell; and a material of the face plate.

12. The method of claim 10, wherein as part of data defining geometrical constraints regarding the size and shape of the wall, the wall is provided to have a mean thickness of less than 0.4 mm.

13. The method of 10, wherein as part of generating the three-dimensional computer model of the shell, the shell is adapted to have a groove or recess within the bonding surface.

14. The method of claim 10, wherein the thickening comprises rounding the rim to a radius of at least 0.2 mm.

15. A hearing device, the hearing device comprising:

a shell forming a wall and an opening, wherein the wall has a rim at the opening, and wherein the wall is thickened along the rim; and a face plate at least partially covering the opening, wherein the rim further comprises a bonding surface, and wherein the face plate is bonded to the shell at the bonding surface, and wherein the bonding surface has a mean width greater than 0.4 mm, and wherein the wall has a mean thickness of less than 0.4 mm excluding the thickened part at the rim.

16. The hearing device of claim 15, wherein the bonding surface forms a groove or recess, wherein the groove or recess is configured to reduce a bonding force between the faceplate and the shell to a predetermined value.

17. The hearing device of claim 15, wherein the wall has a mean thickness of less than 0.2 mm excluding the thickened part at the rim.

18. The hearing device of claim 15, wherein the shell comprises metal.

19. The hearing device of claim 15, wherein the shell comprises titanium.

20. The hearing device 15, wherein the hearing device is a completely-in-canal (CIC) hearing device.

* * * * *